US009448046B2

(12) United States Patent
Simo

(10) Patent No.: US 9,448,046 B2
(45) Date of Patent: Sep. 20, 2016

(54) VANE MOUNTING APPARATUS

(71) Applicant: Miroslav A. Simo, Riverside, IL (US)

(72) Inventor: Miroslav A. Simo, Riverside, IL (US)

(73) Assignee: New Archery Products, LLC, Forest Park, IL (US)

( * ) Notice: Subject to any disclaimer, the term of this patent is extended or adjusted under 35 U.S.C. 154(b) by 0 days.

(21) Appl. No.: 14/209,305

(22) Filed: Mar. 13, 2014

(65) Prior Publication Data

US 2014/0274503 A1 Sep. 18, 2014

Related U.S. Application Data

(60) Provisional application No. 61/794,649, filed on Mar. 15, 2013.

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS

| | | | | |
|---|---|---|---|---|
| 2,887,319 | A * | 5/1959 | Lay | 473/586 |
| 3,815,916 | A * | 6/1974 | Meszaros | 473/586 |
| 4,204,307 | A * | 5/1980 | Pfetzing | 29/407.09 |
| 4,978,130 | A * | 12/1990 | Farler | F42B 6/003 473/586 |
| 8,118,695 | B2 * | 2/2012 | Sutherland et al. | 473/586 |
| 8,485,923 | B2 * | 7/2013 | Kozlik | F42B 6/06 473/586 |
| 2013/0072332 | A1 * | 3/2013 | Blosser et al. | 473/586 |

* cited by examiner

*Primary Examiner* — John Ricci
(74) *Attorney, Agent, or Firm* — Pauley Erickson & Kottis

(57) ABSTRACT

An apparatus for mounting a vane with respect to a shaft of an arrow and/or a bolt. A fletching system includes a sleeve and at least one vane, preferably a plurality of vanes, extending away from the sleeve. In a mounted position of the sleeve with respect to an arrow shaft, the sleeve is removably secured with respect to the arrow shaft. In some embodiments, a stop extends from the sleeve and interferes and/or makes frictional contact with the arrow shaft to prevent movement of the sleeve with respect to the arrow shaft. In other embodiments, an adhesive structure, such as an adhesive tape, contacts the sleeve and the arrow shaft to prevent movement of the sleeve with respect to the arrow shaft.

19 Claims, 2 Drawing Sheets

VANE MOUNTING APPARATUS

CROSS REFERENCE TO RELATED APPLICATION

This application claims the benefit of Provisional U.S. Patent Application Ser. No. 61/794,649, filed 15 Mar. 2013. This co-pending Provisional Patent Application is hereby incorporated by reference herein in its entirety and is made a part hereof, including but not limited to those portions which specifically appear hereinafter.

BACKGROUND OF THE INVENTION

1. Field of the Invention

This invention relates to an apparatus for mounting a vane, such as an archery vane, to an arrow shaft, particularly with a sleeve that is detachably secured directly to or with respect to the arrow shaft.

2. Discussion of Related Art

Conventional fletching systems for attaching arrow vanes to arrow shafts include a sleeve positionable about an outer surface of the arrow shaft and at least one archery vane mounted to an outer surface of the sleeve. Conventional sleeves can have an inner diameter of the sleeve greater than an outer diameter of the arrow shaft, so that the sleeve can be easily slide over the arrow shaft.

Some conventional methods for mounting a shrinkable sleeve having one or more archery vanes on an outer surface of the shrinkable sleeve include heat shrinking the shrinkable sleeve onto the arrow shaft by applying temperature differences to the shrinkable material.

Many conventional methods and apparatuses for attaching vanes using fletching systems require special tools and/or a shop environment, such as hot water tanks, for applying shrinkable materials. Some conventional methods and apparatuses use an adhesive material on the inside of the sleeve to secure the sleeve with respect to the arrow shaft. However, it is difficult to apply such adhesive material and quite often the adhesive material releases and causes movement of the sleeve with respect to the arrow shaft.

SUMMARY OF THE INVENTION

It is one object of this invention to provide a mounting apparatus that can be installed and secured directly to and/or with respect to an arrow shaft, for example, and then removed for repair and/or replacement of the mounting apparatus.

In some embodiments of this invention, a sleeve has at least one vane extending from the sleeve. Each vane can be attached or connected to the sleeve, for example, at or to an outer surface of the sleeve, and/or can be integrated with the sleeve. In certain embodiments of this invention, a plurality of vanes extend from the sleeve and can even be spaced apart from each other to balance the sleeve and vanes assembly, which can help achieve aerodynamic stability, such as during launch and/or flight of an arrow.

In some embodiments of this invention, a stop element extends from the sleeve. In the mounted position of the sleeve to, on or with respect to the arrow shaft, in some embodiments of this invention, the stop interferes with and/or forms a frictional fit with the arrow shaft, for example, to maintain or keep the sleeve to and/or in a fixed position with respect to the arrow shaft. This type of a mounting arrangement can be used to relatively quickly and accurately replace and/or repair a vane, a set of vanes and/or a fletching system, particularly in the field or away from a shop, and in some embodiments without the need for tools, which can be beneficial when hunting in a field, for example.

In other embodiments of this invention, the stop is not a necessary element, and an adhesive structure can be used to maintain the sleeve mounted to and/or in a fixed position with respect to the arrow shaft. In some embodiments of this invention, the adhesive structure can include an adhesive tape that contacts and/or adheres to the sleeve and to the arrow shaft. In some embodiments of this invention, at least a portion of the adhesive structure can be positioned within a void, such as a groove, within the sleeve. The adhesive structure and/or the void within the sleeve can be designed to reduce the overall aerodynamic drag of an arrow, for example, assembled with an arrow shaft, an arrowhead and vanes and/or another suitable fletching system.

In some embodiments of this invention, the stop element can be used in combination with the adhesive structure to fix a position of and/or otherwise secure the sleeve with respect to the arrow shaft. In some embodiments of this invention, the stop element is positioned at or is attached to an end portion of the arrow shaft and adhesive structure is positioned at or is attached to the arrow shaft in a direction towards a front or an arrowhead portion of the arrow. In other embodiments of this invention, the adhesive structure is positioned at or is attached to an end portion of the arrow shaft and the stop element is positioned at or is attached to the arrow shaft in a direction towards a front or an arrowhead portion of the arrow.

It is apparent that the sleeve of this invention, particularly when having the stop element and/or the adhesive structure, according to this invention, can be used to quickly and accurately repair and/or replace one or more vanes, particularly in the field or away from a shop environment, even without the need for special tools.

BRIEF DESCRIPTION OF THE DRAWINGS

The above-described and other features of this invention can be better understood when taken in view of the following drawings, wherein.

DETAILED DESCRIPTION OF THE INVENTION

Figure 1:
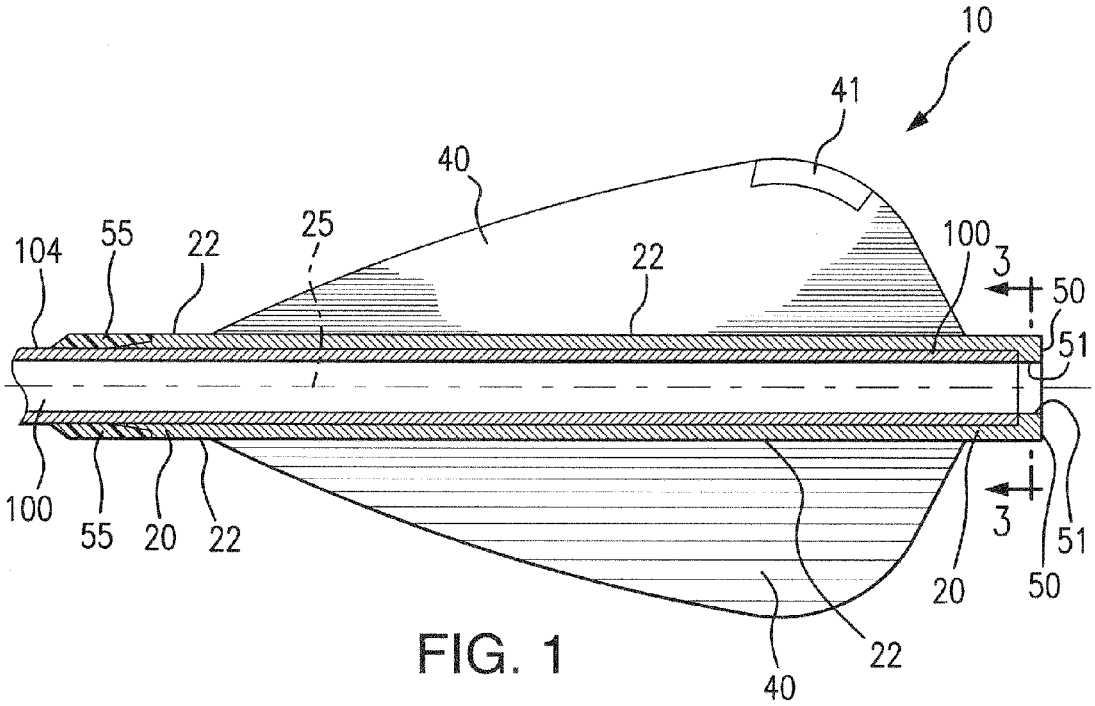
FIG. 1 is a partial cross-sectional view of a fletching system, according to one embodiment of this invention, wherein a stop element is positioned at or is attached to an end portion of an arrow shaft and an adhesive structure is positioned at or is attached to the arrow shaft in a direction towards a front portion or an arrowhead portion of the arrow.
Figure 2:
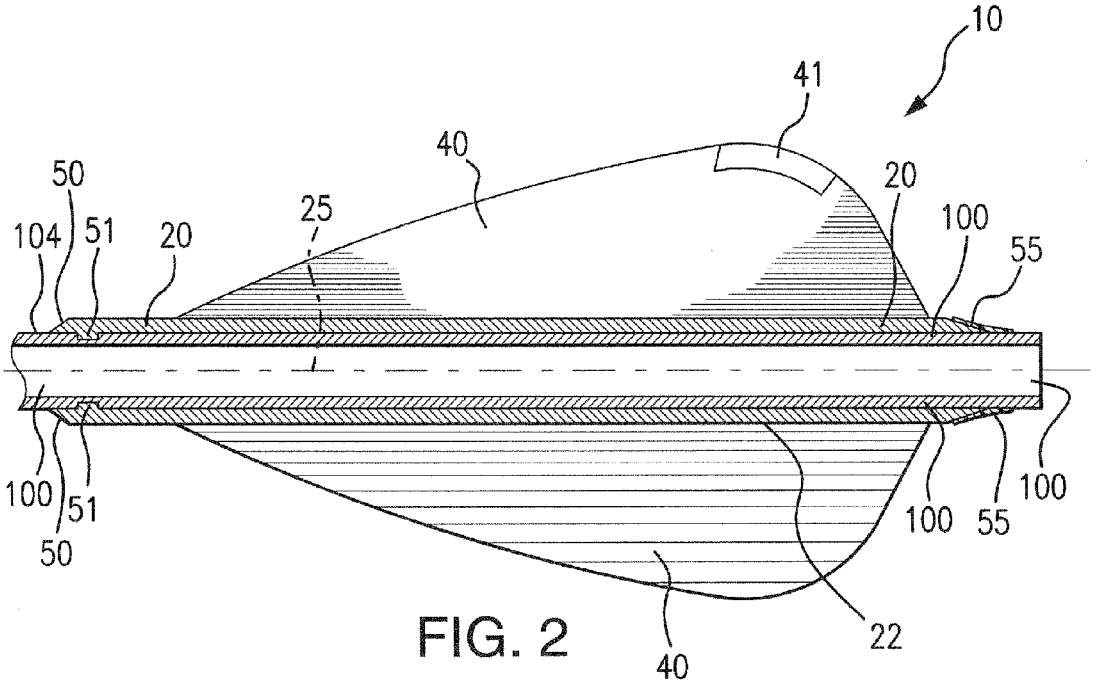
FIG. 2 is a partial cross-sectional view of a fletching system, according to another embodiment of this invention, wherein an adhesive structure is positioned at or is attached to an end portion of an arrow shaft and a stop element is positioned at or is attached to the arrow shaft in a direction towards the front portion or the arrowhead portion of the arrow.

FIGS. 1 and 2 show different embodiments, according to this invention, of fletching system 10 mounted in two different positions or physical arrangements, with respect to arrow shaft 100. Some of the elements and/or steps of this invention are similar to corresponding elements and/or steps of Czemske et al., U.S. Pat. No. 7,074,143, the entire disclosure and teachings of which are incorporated into this specification by reference to Czemske et al., U.S. Pat. No. 7,074,143.

In some embodiments of this invention, such as shown in FIGS. 1 and 2, fletching system 10 and/or a mounting apparatus comprises sleeve 20, at least one vane 40, stop 50 and/or adhesive structure 55. In some embodiments of this invention, sleeve 20 can be installed and secured directly to and/or with respect to arrow shaft 100. With the quick and accurate connection of this invention, using stop 50 and/or adhesive structure 55, fletching system 10 according to this invention can be removed for repair and/or replacement of the mounting apparatus and/or any element or component of fletching system 10, including but not limited to sleeve 20 and/or each vane 40. In some embodiments of this invention, sleeve 20 is constructed of a shrinkable material, such as a heat-shrink material, and/or any other suitable material known to those skilled in the art of archery.

In some embodiments of this invention, sleeve 20 comprises at least one vane 40 extending from the sleeve. In the embodiments shown in FIGS. 1 and 2, fletching system 10 comprises three vanes 40 equally spaced about a periphery or circumference of sleeve 20. However, in other embodiments of this invention, one, two or more than three vanes 40 can be arranged about the periphery or circumference of sleeve 20. Regardless of the number of vanes 40, in some embodiments of this invention, vanes 40 are equally spaced and/or otherwise designed in size, shape and/or material, to provide adequate or sufficient balance, for example, so that fletching system 10 and/or arrow shaft 100 can maintain good aerodynamic performance as the corresponding arrow is launched and during flight.

In some embodiments of this invention, each vane 40 is attached, connected, secured, fixed and/or otherwise maintained in a fixed position on and/or directly to sleeve 20. In some embodiments of this invention, each vane 40 is maintained in a fixed position at or to outer surface 22 of sleeve 20. In some embodiments of this invention, each vane 40 is integrated with and/or formed together with sleeve 20. In certain embodiments of this invention, any one or more vanes 40 can each extend outward, such as from sleeve 20, including but not limited to outward from outer surface 22 of sleeve 20. Vanes 40 can be spaced apart at different distances from each other to balance or to unbalance fletching system 10 of this invention, including sleeve 20 and vanes 40, which can help achieve aerodynamic stability, such as during launch and/or flight of an arrow.

In some embodiments of this invention, vane 40 can have kicker 41. In some embodiments of this invention kicker 41 is integrated with vane 40 and/or can be attached, connected, secured and/or otherwise fixedly positioned with respect to vane 40. Kicker 41 can be used to transfer a force to and/or through vane 40, for example, to impart spin on or rotation of arrow shaft 100 during flight. In some embodiments of this invention, vane 40 comprises grooves, microgrooves and/or any other surface or irregular surface, at least on at least a portion of surface of one side of vane 40, either alone or in combination with kicker 41.

In some embodiments of this invention, stop 50 and/or another suitable stop element extends from sleeve 20. As shown in FIGS. 1 and 2, in the mounted position of sleeve 20 to, on or with respect to arrow shaft 100, in some embodiments of this invention, stop 50 interferes with and/or forms a frictional fit with arrow shaft 100. In some embodiments of this invention, to fix, secure, maintain and/or keep sleeve 20 mounted to and/or in a fixed position with respect to arrow shaft 100. Stop 50 and/or another suitable type of a mounting device or arrangement can be used to relatively quickly and accurately install, replace and/or repair fletching system 10 and/or vane 40, for example, when in the field or away from a shop, and in some embodiments without the need for tools or special tools, which can be beneficial when hunting in a field, for example.

Figure 3:
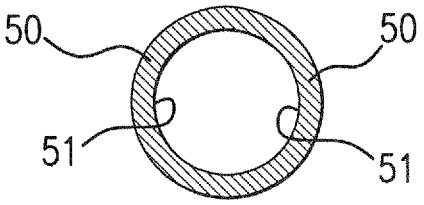
FIG. 3 is a sectional view taken along line 3-3 as shown in FIG. 1, showing a cross-sectional shape of a stop element, according to one embodiment of this invention.
Figure 4:
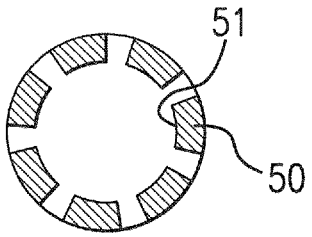
FIG. 4 is a sectional view showing a cross-sectional shape of a stop element, according to another embodiment of this invention.
Figure 5:
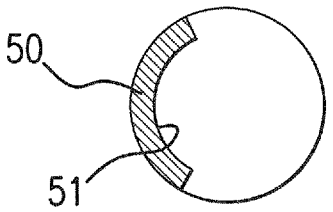
FIG. 5 is a sectional view showing a cross-sectional shape of a stop element, according to still another embodiment of this invention.

As shown in FIGS. 1 and 2, in the mounted position, sleeve 20 is secured about an external surface, such as outer surface 104 of arrow shaft 100. In some embodiments of this invention, stop 40 interferes with arrow shaft 100, for example, to secure sleeve 20 with respect to arrow shaft 100. As shown in FIGS. 1 and 2, stop 50 comprises shoulder 51 extending from sleeve 20. In some embodiments of this invention, shoulder 51 extends inward in a direction toward longitudinal axis 25 of sleeve 20. FIGS. 4 and 5 each shows a different embodiment of shoulder 51 forming a portion of a collar that contacts arrow shaft 100. FIG. 3 shows one embodiment of shoulder 51 forming a complete collar that contacts arrow shaft 100. Stop 50 can be of any suitable material that makes frictional contact and/or a frictional interference fit with arrow shaft 100. In some embodiments of this invention, arrow shaft 100 can have a groove or any other suitable void that can engage with stop 50 to prevent movement of sleeve 20 when in the mounted position.

In some embodiments of this invention, stop 50 is not required and thus may not be a necessary element. As shown in FIGS. 1 and 2, adhesive structure 55 maintains sleeve 20 mounted to and/or in a fixed position with respect to arrow shaft 100. In some embodiments of this invention, adhesive structure 55 comprises an adhesive tape, as shown in FIGS. 1 and 2, that contacts and/or adheres to sleeve 20 and to arrow shaft 100. In some embodiments of this invention, at least a portion or adhesive structure 55 is positioned within a void, such as a tapered slot, a tapered groove, a slot, a groove and/or another suitable opening within sleeve 20 that engages with and accommodates at least a portion of adhesive structure 55, particularly in an aerodynamic manner.

In some embodiments of this invention, adhesive structure 55 and/or the void within sleeve 20 can be tapered, angled and/or otherwise designed to reduce the overall aerodynamic drag of an arrow assembled with an arrow shaft 100, an arrowhead and vanes 40 and/or another suitable fletching system. As shown in FIGS. 1 and 2, adhesive structure 55 is an adhesive tape that contacts a tapered portion or an angled portion of outer surface 22 of sleeve 20 and also contacts outer surface 104 of arrow shaft 100. In some embodiments of this invention, the adhesive tape can fit within a void, such as a tapered void, of sleeve 20, as shown in FIGS. 1 and 2, to reduce the aerodynamic drag of adhesive structure 55 and how it connects and/or attaches between sleeve 20 and arrow shaft 100. In some embodiments of this invention, the adhesive tape or other adhesive structure 55 can be sized and/or shaped or otherwise designed to reduce the aerodynamic drag, for example, by providing an overall stepped, tapered and/or smooth outer skin surface with relatively minimal skin surface disruption as the air flows aerodynamically stable over the corresponding portion of the arrow during launch and/or flight.

In some embodiments of this invention, stop 50 can be used in combination with adhesive structure 55 to fix a position of and/or otherwise secure the sleeve with respect to the arrow shaft. In some embodiments of this invention, such as shown in FIG. 1, stop 50 is positioned at or is attached to an end portion of arrow shaft 100 and adhesive structure 55 is positioned at or is attached to arrow shaft 100 in a direction towards a front or an arrowhead portion of the arrow. In other embodiments of this invention, such as shown in FIG. 2, adhesive structure 55 is positioned at or is attached to an end portion of arrow shaft 100, such as within a groove or shoulder formed within outer surface 104 of arrow shaft 100, and stop 50 is positioned at or is attached to arrow shaft 100 in a direction towards a front or towards an arrowhead portion of the arrow.

In some embodiments of this invention, sleeve 20, particularly when having stop 50 and/or adhesive structure 55, according to this invention, can be used to quickly and accurately repair and/or replace one or more vanes 40, particularly in the field or away from a shop environment, even without the need for special tools.

While in the foregoing detailed description this invention has been described in relation to certain preferred embodiments thereof, and many details have been set forth for purposes of illustration, it will be apparent to those skilled in the art that this invention is susceptible to additional embodiments and that certain of the details described herein can be varied considerably without departing from the basic principles of this invention.

What is claimed is:

1. An apparatus for mounting a vane with respect to an arrow shaft, comprising:

a sleeve, in a mounted position the sleeve removably secured with respect to the arrow shaft, at least one vane extending from the sleeve, a stop extending from the sleeve, in the mounted position the stop interfering with the arrow shaft and maintaining the sleeve in the mounted position, and the sleeve is of a shrinkable material.

2. The apparatus of claim 1, wherein in the mounted position the sleeve is secured about an external surface of the arrow shaft.

3. The apparatus of claim 2, wherein the stop interferes with the arrow shaft to secure the sleeve.

4. The apparatus of claim 1, wherein the stop comprises a shoulder extending from the sleeve.

5. The apparatus of claim 4, wherein the shoulder forms at least a portion of a collar that interferes with the arrow shaft.

6. The apparatus of claim 1, wherein the at least one vane and the sleeve are separately connected with respect to each other or are integrated with each other.

7. The apparatus of claim 1, wherein the sleeve is attached to an end portion of the arrow shaft.

8. The apparatus of claim 1, wherein the at least one vane and the sleeve form a fletching system.

9. An apparatus for mounting a vane with respect to an arrow shaft, comprising: a sleeve, in a mounted position the sleeve removably secured with respect to the arrow shaft, at least one vane extending from the sleeve, a stop extending from the sleeve, in the mounted position the stop interfering with the arrow shaft and maintaining the sleeve in the mounted position, in the mounted position the sleeve secured about an external surface of the arrow shaft, and a band of material contacting the sleeve and the arrow shaft to secure the sleeve.

10. The apparatus of claim 9, wherein the band of material comprises an adhesive tape securely adhered to the sleeve and to the arrow shaft.

11. An apparatus for mounting a vane with respect to an arrow shaft, comprising: a sleeve, in a mounted position the sleeve removably secured with respect to the arrow shaft, at least one vane extending from the sleeve, a stop extending from the sleeve, in the mounted position the stop interfering with the arrow shaft and maintaining the sleeve in the mounted position, and an adhesive structure contacting and securing the sleeve with respect to the arrow shaft.

12. The apparatus of claim 11, wherein the sleeve is of a shrinkable material.

13. An apparatus for mounting a vane with respect to an arrow shaft, comprising: a sleeve, in a mounted position the sleeve removably secured with respect to the arrow shaft, at least one vane extending from the sleeve, a stop extending from the sleeve, in the mounted position the stop interfering with the arrow shaft and maintaining the sleeve in the mounted position, and the sleeve having a void and at least a portion of an adhesive structure is positioned within the void and secures the sleeve with respect to the arrow shaft.

14. An apparatus for mounting a vane with respect to an arrow shaft, comprising: a sleeve, in a mounted position the sleeve removably secured with respect to the arrow shaft, at least one vane extending from the sleeve, a stop extending from the sleeve, in the mounted position the stop interfering with the arrow shaft and maintaining the sleeve in the mounted position, and a nock contacting the stop and securing the sleeve.

15. An apparatus for mounting a vane with respect to an arrow shaft, comprising:

a sleeve, in a mounted position the sleeve removably secured with respect to the arrow shaft, at least one vane extending from the sleeve, and in the mounted position an adhesive structure contacting the sleeve with respect to the arrow shaft and maintaining the sleeve in the mounted position, wherein in the mounted position a stop extends from the sleeve and the stop interferes with the arrow shaft to secure the sleeve.

16. The apparatus of claim 15, wherein in the mounted position an adhesive tape is securely adhered to the sleeve and to the arrow shaft.

17. The apparatus of claim 15, wherein the sleeve is of a shrinkable material.

18. An apparatus for mounting a vane with respect to an arrow shaft, comprising:

a sleeve, in a mounted position the sleeve removably secured with respect to the arrow shaft, at least one vane extending from the sleeve, and in the mounted position an adhesive structure contacting the sleeve with respect to the arrow shaft and maintaining the sleeve in the mounted position, wherein a nock is positioned within the sleeve and secures the sleeve.

19. The apparatus of claim 18, wherein the sleeve is of a shrinkable material.

* * * * *